United States Patent [19]

Usami et al.

[11] Patent Number: 4,486,165

[45] Date of Patent: Dec. 4, 1984

[54] COMBUSTION CONTROL APPARATUS OF A COMBUSTION FURNACE

[75] Inventors: Jun Usami, Gamagori; Hiroshi Yamada, Nagoya, both of Japan

[73] Assignee: NGK Insulators, Ltd., Japan

[21] Appl. No.: 375,304

[22] Filed: May 5, 1982

[30] Foreign Application Priority Data

May 13, 1981 [JP] Japan ..... 56-71946

[51] Int. Cl.[3] ..... F23N 5/00

[52] U.S. Cl. ..... 431/76; 236/15 E; 236/14

[58] Field of Search ..... 431/12, 20, 76, 90; 236/15 E, 14

[56] References Cited

U.S. PATENT DOCUMENTS 4,264,297 4/1981 Van Berkum ..... 431/76

4,330,261 5/1982 Sun ..... 431/14

*Primary Examiner*—Carroll B. Dority, Jr.

*Attorney, Agent, or Firm*—Parkhurst & Oliff

[57] ABSTRACT

A combustion control apparatus of a combustion furnace by an improved fuel and air complementary control system according to master control system is disclosed, which is provided with a regulating means connected to a master controller and adapted for detecting the amount of load change and for setting the length of an air damper control rod's length changing device to a preset standard value corresponding to the load, without controlling the oxygen concentration in the exhaust gas to a standard value, when the load change is increased to a value of not lower than the preset value. The combustion control apparatus can control stably the oxygen concentration in an exhaust gas to a low level even when a load is suddenly changed.

4 Claims, 8 Drawing Figures

COMBUSTION CONTROL APPARATUS OF A COMBUSTION FURNACE

BACKGROUND OF THE INVENTION

1. Field of the Invention

The present invention relates to a combustion control apparatus of a combustion furnace, and more particularly relates to a combustion control apparatus of a combustion furnace for boiler by an improved fuel and air complementary control system according to master control signal, in which a fuel damper and an air damper are controlled in a certain opening position ratio to control the fuel quantity and air quantity, and the fuel is combusted to obtain a given heat; and at the same time the concentration of oxygen remaining in a combustion exhaust gas is rapidly controlled even when a disturbance occurs in the exhaust gas, to decrease the quantity of fuel to be used and to decrease the NOx concentration and SOx concentration in the exhaust gas.

2. Description of the Prior Art

In the air to fuel ratio control by a conventional fuel and air complementary control system according to master control signal, as illustrated in FIG. 1, a load detector 1, which detects the pressure of generated steam, and a master controller 2, which is electrically connected to the load detector 1 and actuates corresponding to the changed value of the pressure of generated steam, are arranged. A drive shaft 5 is connected, at one hand, to the master controller 2 and is driven by the controller 2; and is connected, at the other hand, to a fuel damper opening position control rod 9 and to an air damper opening position control rod 10 through link mechanisms 6 and 7, respectively. A fuel damper 11 and an air damper 12 are opened or shut at a given opening amount ratio by the movement of the fuel damper opening position control rod 9 and the air damper opening position control rod 10, whereby fuel quantity is determined and air quantity is roughly controlled. Further, the air quantity is finely controlled by the following control apparatus, which is practically used at present. An air damper control rod's length changing device 13, which is freely movable and is elongated in itself by an electric signal, is arranged between the air damper opening position control rod 10 and the air damper 12; the oxygen concentration in a combustion exhaust gas is detected as an electric signal by an oxygen detector 14; and the amount of combustion load defined by the actuated amount of the drive shaft 5 through a link mechanism 8 connected to the drive shaft 5, is detected as an electric signal by a load detector 15 for oxygen control, and these detected results are introduced into an oxygen concentration controller 16, whereby the elongation or contraction amount of the air damper control rod's length changing device 13 is increased or decreased so as to obtain a preset standard oxygen concentration corresponding to the load and to effect a fine control of the air quantity.

However, in such control apparatus, when the combustion load is suddenly changed, that is, a disturbance occurs during the combustion, the oxygen concentration in the combustion exhaust gas is transiently increased or decreased and is noticeably changed due to the variation of the combustion load as illustrated in three figures of FIG. 2. One of the reasons of this phenomenon is as follows. In the conventional fuel and air complementary control system according to master control system, wherein a fuel damper and an air damper are concurrently opened or shut in a given ratio to control the fuel quantity and air quantity through link mechanisms depending upon the variation of combustion load, the static properties of the fuel damper and air damper do not agree to each other as illustrated in FIGS. 3*a*, 3*b* and 3*c*.

That is, the static property to the fuel damper between its opening position and the fuel quantity passed therethrough does not agree to the static property of the air damper between its opening position and the air quantity passed therethrough. Moreover, it takes a certain period of time to flow the combustion exhaust gas from the combustion furnace to the exhaust gas channel, and therefore a time lag occurs between the oxygen concentration change in the exhaust gas and the control operation by the oxygen concentration controller 16 and the air damper control rod's length changing device 13.

Accordingly, when the combustion load is changed, the air quantity becomes transiently short, and the oxygen concentration in the combustion exhaust gas becomes transiently lower than the sooty smoke-generating oxygen concentration inherent to the combustion furnace and burner, to generate transiently sooty smoke. Alternatively, the air quantity becomes transiently excess, and the oxygen concentration in the combustion exhaust gas becomes transiently considerably higher than the preset standard oxygen concentration.

When sooty smoke is repeatedly generated, even though each generation time of the sooty smoke is short, soot is adhered to waterpipes or is accumulated on the wall of flue to decrease the heat efficiency. While, when combustion is carried out under an excess air, NOx concentration and SOx concentration in the combustion exhaust gas are increased, and therefore such combustion is unfavorable in view of energy saving and public nuisance. In order to obviate these drawbacks, in the conventional control apparatus, an oxygen detector having a rapid response speed has been used. However, there is a time lag due to the passing time of combustion gas as described above, and therefore it is difficult to decrease the fluctuation of oxygen concentration in the exhaust gas due to the sudden change of combustion load. Accordingly, when load changes in a wide range and the stabilities of steam pressure and air-to-fuel ratio are particularly required, there is practically used a method, wherein a fuel quantity setting regulator and an air quantity setting regulator are arranged independently to each other, and the control signal caused in the master controller is transmitted to the fuel quantity setting regulator and the air quantity setting regulator to control separately the fuel quantity and the air quantity.

However, such high-class control apparatus has a complicated control system, and requires a very high installation cost and a very high technic for its maintenance. Therefore, the control apparatus has been only used for a relatively large capacity boiler, whose operation cost is predominantly occupied by the fuel cost, and which has not hitherto been used for a relatively simple boiler of middle and small capacity. Under these circumstances, there has been demanded the development of a combustion control apparatus having the same controlling effect as that of a high-class control system, that is, the development of a combustion control apparatus, which is free from a transient variation of oxygen concentration in the combustion exhaust gas even in the case where the combustion load is suddenly changed, and concurrently has such merits that the control system is simple, the maintenance is easy and the installation cost is low, in a fuel and air complementary control system combustion control apparatus widely used in a simple combustion furnace for middle and small capacity boilers.

SUMMARY OF THE INVENTION

The present invention is intended to solve the above described problems. The present invention provides a fuel and air complementary control system combustion control apparatus according to master control signal capable of always controlling stably the combustion even in the case where the disturbance occurs during the combustion due to the fluctuation of combustion load.

The feature of the present invention is the provision of a combustion control apparatus for controlling the fuel quantity and air quantity in a combustion furnace, comprising a load detector for detecting the load of the combustion furnace; a master controller connected to the load detector and actuating corresponding to the load; means which are connected to the master controller and transmit the actuation of the master controller to a fuel damper and an air damper respectively to control the opening positions of the dampers under a given condition; an air damper control rod's length changing device, which is connected to the means for controlling the opening position of the air damper, and elongates and contracts in itself to control the opening position of the air damper independently of the fuel damper; and a means, which detects the oxygen concentation in the exhaust gas of the combustion furnace, and elongates and contracts the above described air damper control rod's length changing device so as to control the oxygen concentration in the combustion furnace to the standard value, the improvement comprising a regulating means connected to the above described master controller and adapted for detecting the amount of load change and for setting the length of air damper control rod's length changing device to a present standard value corresponding to the load change, without controlling the oxygen concentration in the exhaust gas to the standard value, when the load change is increased to a value of not lower than the preset value.

DESCRIPTION OF THE PREFERRED EMBODIMENT

Figure 4:
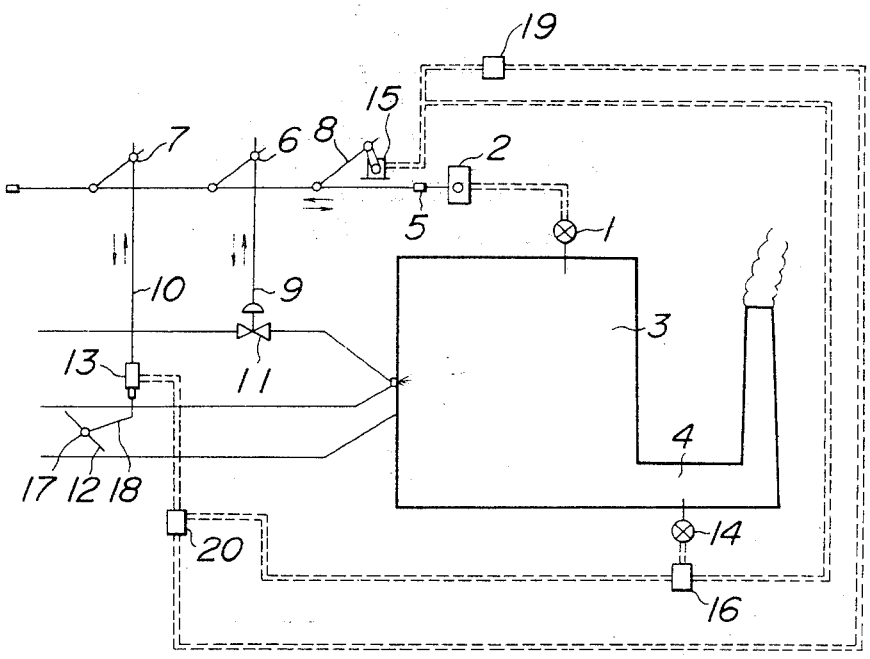
FIG. 4 is a schematic diagram illustrating one embodiment of the combustion control apparatus of the present invention.

One embodiment of the present invention will be explained in more detail referring to FIG. 4. In a combustion control apparatus of a combustion furnace illustrated in FIG. 4, wherein a drive shaft 5 driven by a master controller 2 corresponding to the load change of the combustion furnace is bonded to a fuel damper opening position control rod 9 and an air damper opening position control rod 10 which are connected to a fuel damper 11 and an air damper 12 by means of proportional link mechanisms 6 and 7 respectively, and fuel is mixed with air in a proper mixing ratio and combusted; and an air damper control rod's length changing device 13, which cooperates with the air damper opening position control rod 10 and is extensible in itself by an electric signal, is arranged between an air damper operating lever 18 for rotating an air damper shaft 17 and the air damper opening position control rod 10 for controlling the lever 18, and the opening position of the air damper 12 is adjusted to its opened or closed position by the moving or the extension and contraction of the device 13. Further, the combustion control apparatus of a combustion furnace is provided with a load detector 15 for oxygen control, which converts the combustion load defined by the actuated amount of the drive shaft 5 into an electric signal through a link mechanism 8 arranged on the drive shaft 5. An oxygen detector 14 consisting of a solid electrolyte or the like is arranged in an exhaust gas channel 4 in order to detect the oxygen concentration in the combustion exhaust gas, and is connected to an oxygen concentration controller 16, which receives the electric oxygen concentration signal detected by the oxygen detector 14, and transmits an electric signal corresponding to the difference between detected signal and the preset oxygen concentration, as an elongation driving signal, to an air damper control rod's length changing device 13 through a device 13's rod's length setting regulator 20. A furnace load ratio change detector 19 detects the load change obtained by the load signal, and generates a trigger signal when the load change is larger than the preset value. The load detector 15 is connected to the device 13's rod's length setting regulator 20 through the furnace load ratio change detector 19, which generates an electric signal corresponding to the load of the combustion furnace. The device 13's rod's length setting regulator 20 serves to control the elongation or contraction amount of the air damper control rod's length changing device 13, and is electrically connected to the oxygen concentration controller 16, to the furnace load ratio change detector 19 and to the air damper control rod's length changing device 13.

The device 13's rod's length setting regulator 20 has an electric circuit, which receives an elongation driving signal from the oxygen concentration controller 16 and transmits the elongation driving signal to the air damper control rod's length changing device 13 and further receives a feedback signal from the device 13 and controls the length of the device 13 during the stationary combustion under a small load change.

Further, the device 13's rod's length setting regulator 20 has a switch circuit, which cuts an operation circuit of the elongation driving signal transmitted from the above described oxygen concentration controller 16 when the regulator 20 has received a trigger signal from the furnace load ratio change detector 19; has an electric circuit which receives a load electric signal transmitted from the furnace load ratio change detector 19 and transmits an elongation driving signal to the air damper control rod's length changing device 13, while collating the load electric signal with the feedback signal generated from the device 13, to control the length of the device 13 to a preset standard length; and has a switch circuit which restores the control circuit by the oxygen concentration controller 16 when the load change has been completed and stabilized. In the above described explanation, the preset standard length of the air damper control rod's length changing device 13 is an actually measured value of the length of the air damper control rod's length changing device 13 within an anticipated load change range, which value eliminates the difference between a preset standard oxygen concentration and an oxygen concentration, which has been controlled only by a master controller and a link mechanism cooperated with the master controller, in the exhaust gas of a combustion furnace provided with the control apparatus of the present invention. That is, the standard length of the air damper control rod's length changing device 13 is a standard control value, which is previously set in an electric circuit of the device 13's rod's length setting regulator 20 as an optionally and occasionally changeable value. In other words, the preset standard length of the air damper control rod's length changing device 13 is a value which compensates the disagreement in the static properties between the fuel damper and the air damper.

Figure 5:
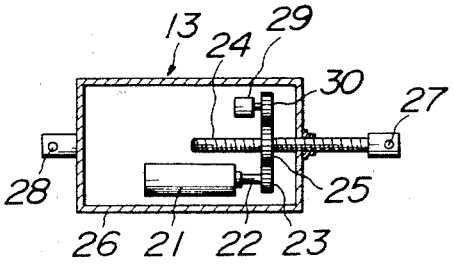
FIG. 5 is an explanative view of one embodiment of an air damper control rod's length changing device used in the combustion control apparatus illustrated in FIG. 4.

FIG. 5 illustrates one embodiment of the air damper control rod's length changing device 13. Referring to FIG. 5, the device 13 comprises a reversible electric motor 21 which is driven by an electric signal from the device 13's rod's length setting regulator 20; a gear 23 directly connected to the rotation axis of the electric motor 21; a gear 25 which is engaged with the gear 23 and further with a screwed long rod 24 having a linkage connector 27 at one end and capable of moving in its axial direction; and a casing 26 which receives the above described elements and has another linkage connector 28. The electric motor 21 and gear 23 are fixed to the casing not to move in the axial direction of the device 13, and the screwed long rod 24 is arranged in the casing so as to be able to move in the axial direction of the device 13. Further, as a detector for the elongation or contraction amount, a rheostat 29, whose resistance is varied, for example, by the rotation of its axis as illustrated in FIG. 5, is arranged in the casing through a gear 30 engaged with the gear 25, so that the elongation or contraction amount of the device 13 can be converted into an electric signal and can be transmitted to the device 13's rod's length setting regulator 20 as a feedback signal. That is, the feedback signal of the rheostat 29 and the signal of the device 13's rod's length setting regulator 20 are electrically collated with each other, and the elongation or contraction amount is controlled to a directed elongation or contraction amount.

The air damper control rod's length changing device 13 has the above described structure, and when the electric motor 21 is rotated in a clockwise or anti-clockwise direction by an elongation driving signal from the device 13's rod's length setting regulator 20, the gears 23, 25 and 30 are rotated, and the screwed long rod 24 is slid in its axial direction corresponding to the rotation of the gears to increase or decrease the distance between the linkage connectors 27 and 28, and the device 13 is elongated or contracted as a whole.

The air damper control rod's length changing device 13 is not limited to one illustrated in FIG. 5, but ones having any structure, wherein the device 13 is movably connected and is elongated or contracted by the signal from the device 13's rod's length setting regulator 20 and further the elongated or contracted amount can be controlled by the signal from the regulator 20.

The actuation mechanism of the control apparatus of the present invention will be explained hereinafter. When the combustion furnace provided with the above described combustion control apparatus is stationarily operated, the fuel quantity and air quantity are concurrently controlled by means of proportional link mechanisms 6 and 7; and the oxygen concentration controller 16 receives the electric oxygen concentration signal detected by the oxygen detector 14 arranged in the exhaust gas channel 4, and transmits an electric signal proportional to the difference signal between the detected signal and the preset standard oxygen concentration, as an elongation driving signal, to the air damper control rod's length changing device 13 through the device 13's rod's length setting apparatus 20 to elongate or contract electrically the device 13, whereby the opening position of the air damper 12 is finely regulated so that the oxygen concentration in the exhaust gas is agreed to the standard oxygen concentration. As the result, the above described oxygen concentration is controlled to the standard value.

However, when a load is suddenly changed, a load detector 15 for oxygen control detects the load from the actuation of the master controller 2 in parallel to the control by the above described link mechanism, and transmits the load to the furnace load ratio change detector 19.

The furnace load ratio change detector 19 generates a trigger signal corresponding to the load change. Therefore, the device 13's rod's length setting regulator 20, which has received the trigger signal, changeovers the control operation by the above described oxygen concentration regulator 16 to the control operation by the furnace load ratio change detector 19, and at the same time generates, corresponding to the load electric signal transmitted from the furnace load ratio change detector 19, an elongation driving signal such that the air damper control rod's length changing device 13 will be elongated or contracted so as to be agreed to the preset standard length, to adjust the length of the device 13. As the result, the opening position of the air damper 12 is controlled not only by the link mechanism but also by the air damper control rod's length changing device 13, and therefore air can be supplied in an amount suitable for keeping the oxygen concentration in the exhaust gas to the standard oxygen concentration, and the combustion furnace can be rapidly controlled so as to be operated under a preferable oxygen concentration in the exhaust gas. After the load is stabilized, the control system by the above described oxygen concentration in exhaust gas is restored, and a normal controlling is carried out.

The term "preset oxygen concentration" used in the present invention means a value determined as a lowest oxygen concentration in an exhaust gas by taking a safety factor into consideration with respect to the sooty smoke generatng oxygen concentration inherent to the characteristic properties of the combustion furnace and burner. The standard oxygen concentration may be set to a definite value determined by the characteristic properties of the combustion furnace and burner, but is preferred to be set to a most preferable value depending upon the combustion load. Further, the preset load change value can be previously determined by an experiment as a changed value of the disturbance of oxygen concentration in an exhaust gas, which disturbance occurs in the control of oxygen concentration by the link mechanism and by the oxygen concentration controller. Further, in this specification, the load detector, furnace load ratio change detector, oxygen concentration controller, and device 13's rod's length setting regulator have been explained as separate apparatuses. However, a unitary apparatus consistng of a composite electric circuit having the above described functions can be of course used. Moreover, in the specification, an explanation has been made with respect to combustion furnaces for boiler. However, of course, the combustion furnace, to which the control apparatus of the present invention can be applied, is not limited to combustion furnaces for boiler.

Figure 1:
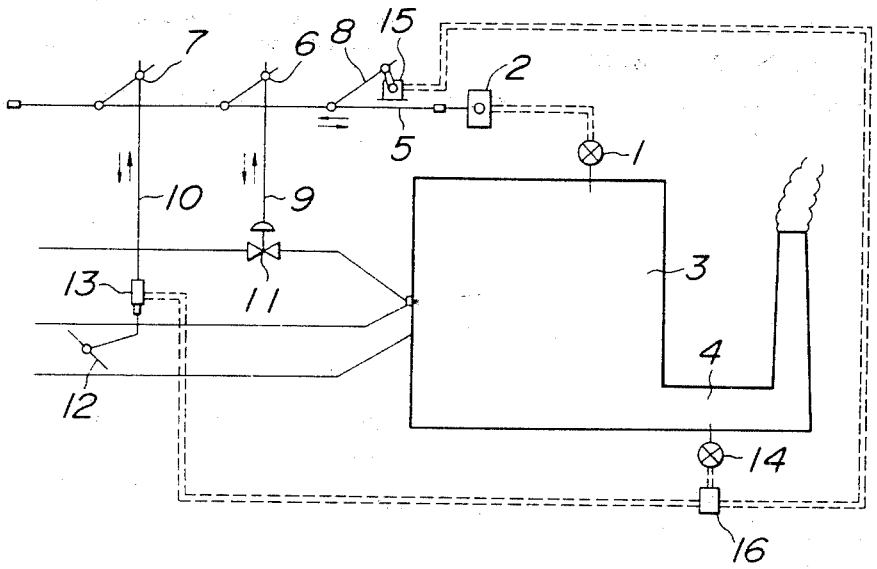
FIG. 1 PRIOR ART
FIG. 1 is a schematic diagram illustrating the outline of a conventional control apparatus explained above.
Figure 2:
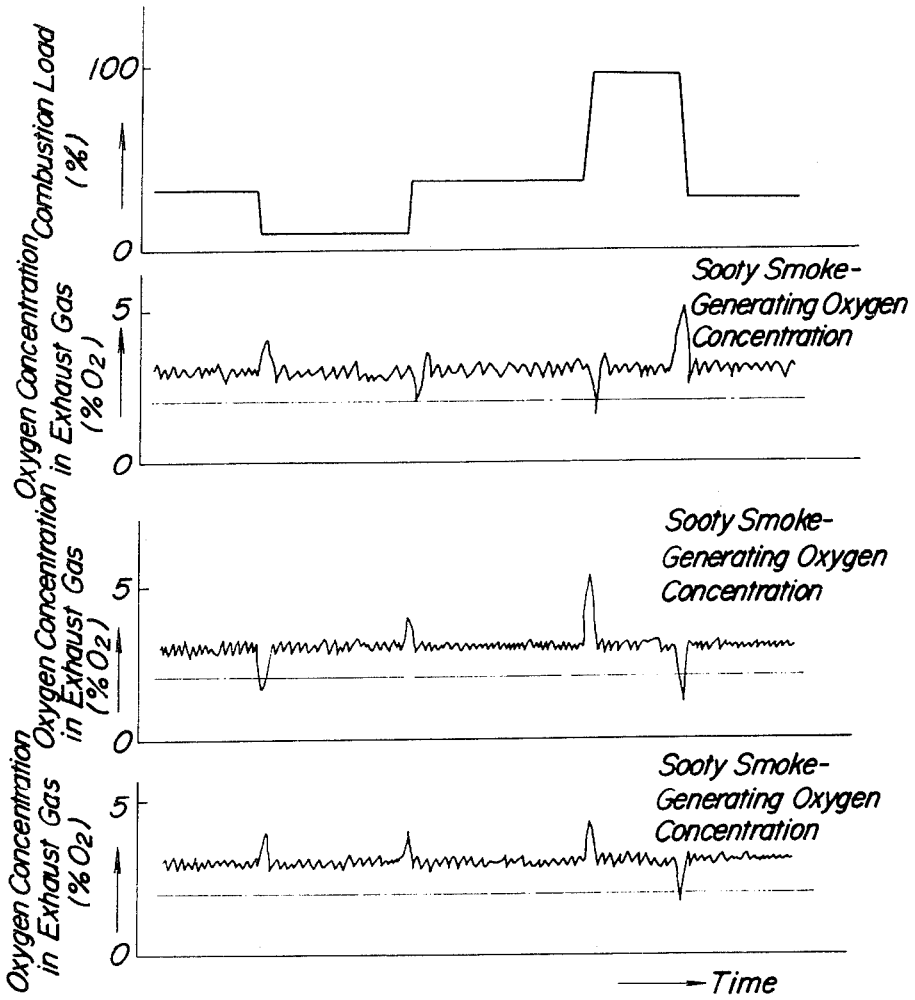
FIG. 2 PRIOR ART
FIG. 2 is a model diagram illustrating the change of oxygen concentration in an exhaust gas with the lapse of time in the use of the conventional apparatus illustrated in FIG. 1.
Figure 3A:
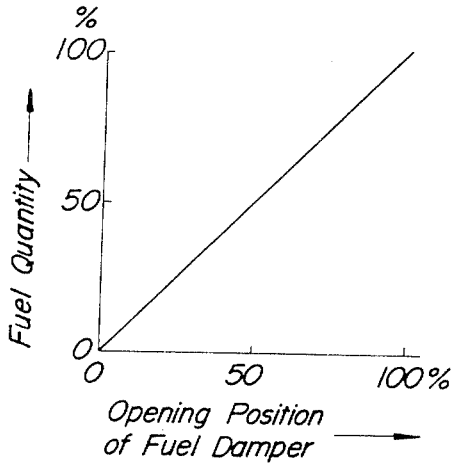
FIG. 3a PRIOR ART
FIG. 3*a* is a graph illustrating a static property of a fuel damper.
Figure 3B:
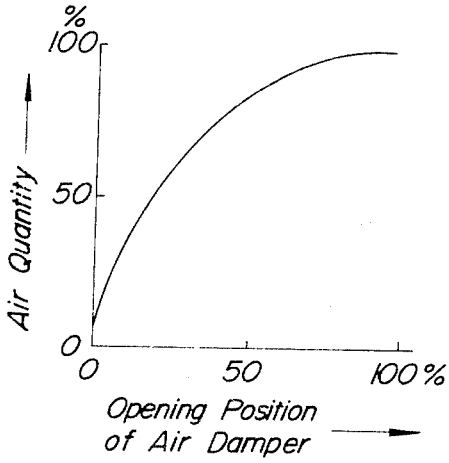
FIG. 3b PRIOR ART
FIGS. 3*b* and 3*c* are graphs illustrating static properties of air dampers.
Figure 3C:
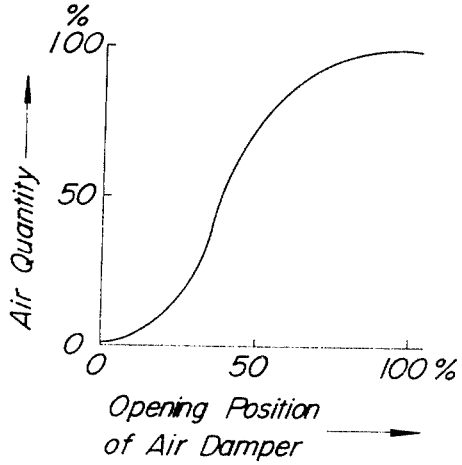
FIG. 3c PRIOR ART
Figure 6:
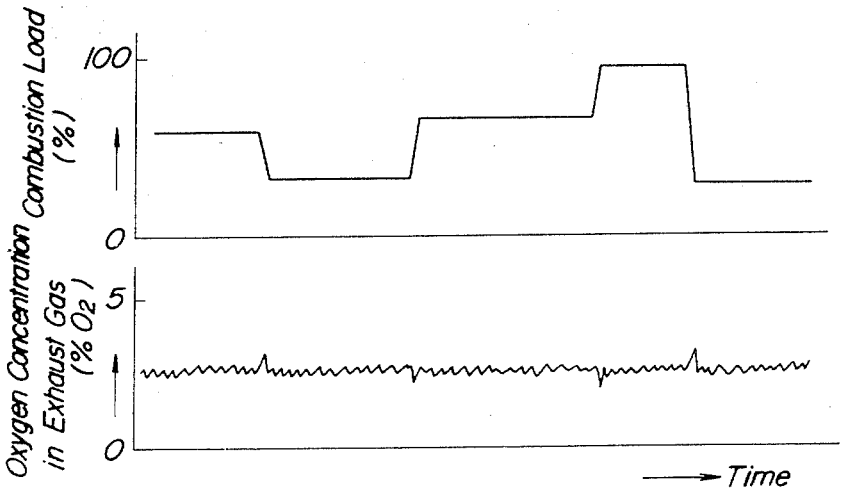
FIG. 6 is a model diagram illustratng the change of oxygen concentration in an exhaust gas with the lapse of time in the use of the apparatus of the present invention illustrated in FIG. 4.

The combustion control apparatus of the present invention has the above described structure, and therefore not only when a load of a furnace is gently changed, but also even when a disturbance, such as sudden change of combustion load, occurs, the combustion load change is detected through the main controller, load detector and furnace load ratio change detector, and at the same time an air quantity can be finely regulated by elongating or contracting the air damper control rod's length changing device 13 to a preset value through the furnace load ratio change detector and the device 13's rod's length setting regulator depending upon the load. Therefore, the combustion control apparatus of the present invention can control stably the combustion without causing time lag which occurs always in the control of combustion by means of only an oxygen concentration controller in a conventional apparatus. FIG. 6 illustrates the change of oxygen concentration in a combustion exhaust gas with the lapse of time in the control of combustion of a practically operating boiler by means of the combustion control apparatus of the present invention. That is, according to the combustion control apparatus of the present invention, even when combustion load is changed, the oxygen concentration can be always kept stably and further can be controlled to a low oxygen concentration as compared with the oxygen concentration controlled by means of a conventional combustion control apparatus and illustrated in FIG. 2.

It can be seen from the above-described example that, according to the combustion control apparatus of the present invention, the oxygen concentration in the exhaust gas can be controlled to a low concentration, which is about 0.5% lower than the oxygen concentration controlled by a conventional combustion control apparatus, and the NOx concentration and SOx concentration in the exhaust gas of combustion furnace can be decreased. Moreover, in the combustion control apparatus of the present invention, there is no transient generation of sooty smoke, and therefore the apparatus can be continuously operated for a long period of time under the lower oxygen concentration, resulting in the fuel saving. Accordingly, the present invention is very contributable in view of energy saving and prevention of public nuisance.

What is claimed is:

1. A combustion control apparatus for controlling fuel and air amounts entering a combustion furnace, comprising:

a first load detector means for detecting a load on the combustion furnace and generating an output corresponding to the detected load;

master controller means for receiving the output of the first load detector means, the master controller means being actuated in an amount corresponding to the output received from the first load detector means;

linkage means connected to the master controller, for transmitting the actuation of the master controller to a fuel damper and an air damper, respectively, thereby controlling the amount of opening in the air and fuel dampers, the air damper having a control rod length changing device being connected in a substantially parallel manner to the linkage means from the master controller, the length changing device being capable of elongating and contracting the linkage means, thereby controlling the amount of opening in the air damper, independently from the amount of opening in the fuel damper;

oxygen concentration detector means for detecting an oxygen concentration in an exhaust gas from the combustion furnace and generating a corresponding output;

an oxygen concentration controller which receives the output of the oxygen concentration detector, the oxygen concentration controller causing the length changing device to elongate or contract, thereby maintaining the oxygen concentration in the combustion furnace at a standard value;

a furnace load ratio change detector connected to a second load detector means, the furnace load ratio change detector generating an output when the output of the second load detector means exceeds a predetermined value;

a length setting regulator electrically connected to the furnace load ratio change detector, the length setting regulator receiving the output from the furnace load ratio change detector and causing the output from the oxygen concentration controller to be non-controlling as an input for the length changing device, the length changing device being controlled exclusively by the output from the furnace load ratio change detector, thereby causing the length changing device to change the length of the linkage means for the air damper to a predetermined length, the length changing device being subsequently controlled by the output from the oxygen concentration controller after the length changing device has caused the air damper linkage to achieve a predetermined length;

wherein the length changing device comprises;

an outer protective casing for protecting all elements of the length changing device contained therein, the outer casing having an inner surface and an outer surface;

a reversible electric motor attached to the inner surface of the outer protective casing, the reversible electric motor being controlled by the output of the length setting regulator;

gear means, mounted within the outer protective casing, for transmitting the motion of the electric motor to the air damper linkage;

sensing means for detecting the elongation or contraction of the air damper linkage, the sensing means being connected with said gear means; and means for delivering a feedback signal from said sensing means to said length setting regulator for controlling the length of the length changing device during stationary combustion under a small load change.

2. The apparatus of claim 1, wherein the sensing means for detecting the elongation or contraction of the air damper linkage comprises a variable rheostat.

3. A combustion control apparatus for controlling fuel and air amounts entering a combustion furnace, comprising:

a first load detector means for detecting a load on the combustion furnace and generating an output corresponding to the detected load;

master controller means for receiving the output of the first load detector means, the master controller means being actuated in an amount corresponding to the output received from the first load detector means;

linkage means connected to the master controller, for transmitting the actuation of the master controller to a fuel damper and an air damper, respectively, thereby controlling the amount of opening in the air and fuel dampers, the air damper having a control rod length changing device being connected in a substantially parallel manner to the linkage means from the master controller, the length changing device being capable of elongating and contracting the linkage means, thereby controlling the amount of opening in the air damper, independently from the amount of opening in the fuel damper;

oxygen concentration detector means for detecting an oxygen concentration in an exhaust gas from the combustion furnace and generating a corresponding output;

an oxygen concentration controller which receives the output of the oxygen concentration detector, the oxygen concentration controller causing the length changing device to elongate or contract, thereby maintaining the oxygen concentration in the combustion furnace at a standard value;

a furnace load ratio change detector connected to a second load detector means, the furnace load ratio change detector generating an output when the output of the second load detector means exceeds a predetermined value;

a length settng regulator electrically connected to the furnace load ratio change detector, the length setting regulator receiving the output from the furnace load ratio change detector and causing the output from the oxygen concentration controller to be non-controlling as an input for the length changing device, the length changing device being controlled exclusively by the output from the furnace load ratio change detector, thereby causing the length changing device to change the length of the linkage means for the air damper to a predetermined length, the length changing device being subsequently controlled by the output from the oxygen concentration controller after the length changing device has caused the air damper linkage to achieve a predetermined length;

wherein the length changing device comprises;

an outer protective casing for protecting all elements of the length changing device contained therein, the outer casing having an inner surface and an outer surface, one longitudinal end of the outer protective casing having a threaded hole therein;

a threaded screw rod extending through said threaded hole, one end of the threaded screw rod protruding into said protective casing and one end of the threaded screw rod protruding out of said protective casing;

a first linkage connector fixed to the outer end of the threaded screw rod;

a first gear axially fixed to a portion of the threaded screw rod protruding into said protective casing;

a reversible electric motor fixed to an inner surface of the outer protective casing, the electric motor having a driving rotatable axis;

a second gear fixed to said driving rotatable axis, the second gear drivingly engaged with said first gear, thereby providing for an inward or outward displacement of the screw rod from the outer protective casing;

sensing means for detecting the elongation or contraction of the air damper linkage;

means for delivering a feedback signal from said sensing means to said length setting regulator for controlling the length of the length changing device during stationary combustion under a small load change;

a third gear connected with said first gear, the third gear providing an input for said sensing means; and a second linkage connector fixed to another longitudinal end of the outer protective casing in a position substantially opposite to and parallel with the first linkage connector.

4. The apparatus of claim 3, wherein the sensing means for detecting the elongation or contraction of the air damper linkage comprises a variable rheostat.

* * * * *